United States Patent [19]

Scholle

[11] 4,008,984

[45] Feb. 22, 1977

[54] PUMP APPARATUS

[76] Inventor: William R. Scholle, 3000 Via Mondo, Compton, Calif. 90224

[22] Filed: Oct. 23, 1975

[21] Appl. No.: 625,252

[52] U.S. Cl. ..... 417/393; 417/395

[51] Int. Cl.[2] ..... F04B 43/06; F04B 45/00; F04B 17/00; F04B 35/00

[58] Field of Search ..... 417/392–395

[56] References Cited

UNITED STATES PATENTS

| | | | |
|---|---|---|---|
| 2,798,440 | 7/1957 | Hall | 417/393 |
| 3,329,094 | 7/1967 | Harklau et al. | 417/393 |
| 3,652,187 | 3/1972 | Leeffler et al. | 417/393 |

*Primary Examiner*—William L. Freeh
*Assistant Examiner*—G. P. LaPointe
*Attorney, Agent, or Firm*—George J. Netter

[57] ABSTRACT

Flexible diaphragms mounted on the ends of a shaft contact a liquid to be dispensed (e.g., syrup bases). A chamber is located about the shaft side of each diaphragm, which chamber is in communication via shaft passages with outlets in the shaft wall. A valving member is slidingly received on the shaft and interconnected with a source of pressurized gas by a flexible hose. The valving members transfers from a position where one opening is in communication with the pressurized gas and the other opening is exposed, to a second position where the relationship of the shaft openings to the valving member is reversed. A pair of opposed coil openings urge the valving member past the longitudinal shaft center to reverse direction after the coils are sufficiently loaded, which results when the valving member is at the end of either shaft stroke.

6 Claims, 4 Drawing Figures

PUMP APPARATUS

The present invention relates generally to a pump apparatus, and, more particularly, to such a pump apparatus especially adapted for the pressurized delivery of soda fountain syrup bases or the like to a dispensing outlet.

OBJECTS AND SUMMARY OF THE INVENTION

It is a primary aim and object to provide improved pump apparatus for providing continuously pressurized syrup bases or the like to a selectively controllable dispenser.

A further object is the provision of such a pump apparatus having double-acting pressurizing diaphragms actuated by a common shaft and a spindle valve on the shaft alternating the supplying of a pressurized gas onto each diaphragm.

Yet another object is the provision in such pump apparatus of a sliding spindle valve spring loaded in two directions giving positive switching of pressurized fluid from one diaphragm to the other.

In the practice of this invention a pair of flexible diaphragms mounted on the respective ends of a shaft have their outwardly directed surface in contact with a liquid to be dispensed (e.g., syrup bases). A chamber is located about the shaft side of each diaphragm, which chamber are in communication via individual passageways along the shaft with separate openings in the shaft wall located closely adjacent one another. An annular valving member is slidingly received on the shaft and is interconnected with a source of pressurized gas by a flexible hose. A friction seal ring is secured on the shaft between the centrally located openings and cooperates with interfering parts on the valving member to provide resistance to transference of the member from a position where one opening is in communication with the pressurized gas and the other opening is exposed, to a second position where the relationship of the shaft openings to the valving member is reversed. In addition, the pressurized gas acting on the valving member internal parts aid retention of the relative position of the member on the shaft. A pair of opposed coil springs urge the valving member past the longitudinal shaft center to reverse direction after the coils are sufficiently loaded, which results when the valving member is at the end of either shaft stroke.

In operation, gas pressure is first applied through the valving member along the shaft passageway to pressurize the associated diaphragm and thereby pump liquid to the selectively controllable outlet. Movement of the shaft also moves the other diaphragm in a non-pressurizing direction. This same shaft movement also moves the valving member against one of the coil springs increasing the spring's resistance until the retardation of the friction ring is overcome, at which time the valving member is snapped to its other valving condition. This procedure is repeated as long as the dispensing outlet is open and liquid is being dispensed as a pressurized stream. When the dispensing outlet is closed, sufficient back-pressure is exerted on the diaphragms to prevent shaft movement.

DESCRIPTION OF A PREFERRED EMBODIMENT

Figure 1:
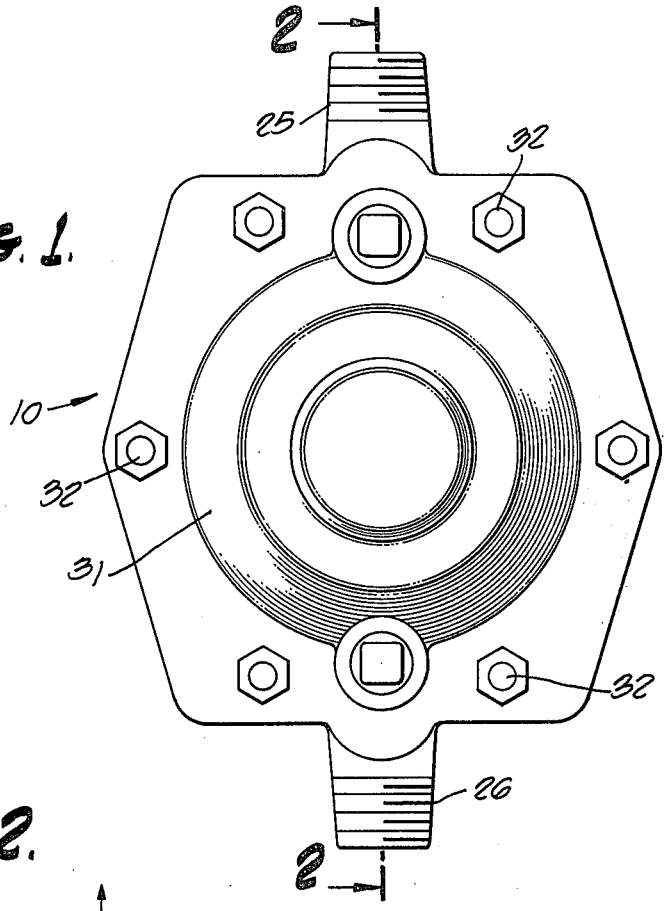
FIG. 1 is an end elevational view of the pumping apparatus of this invention.
Figure 2:
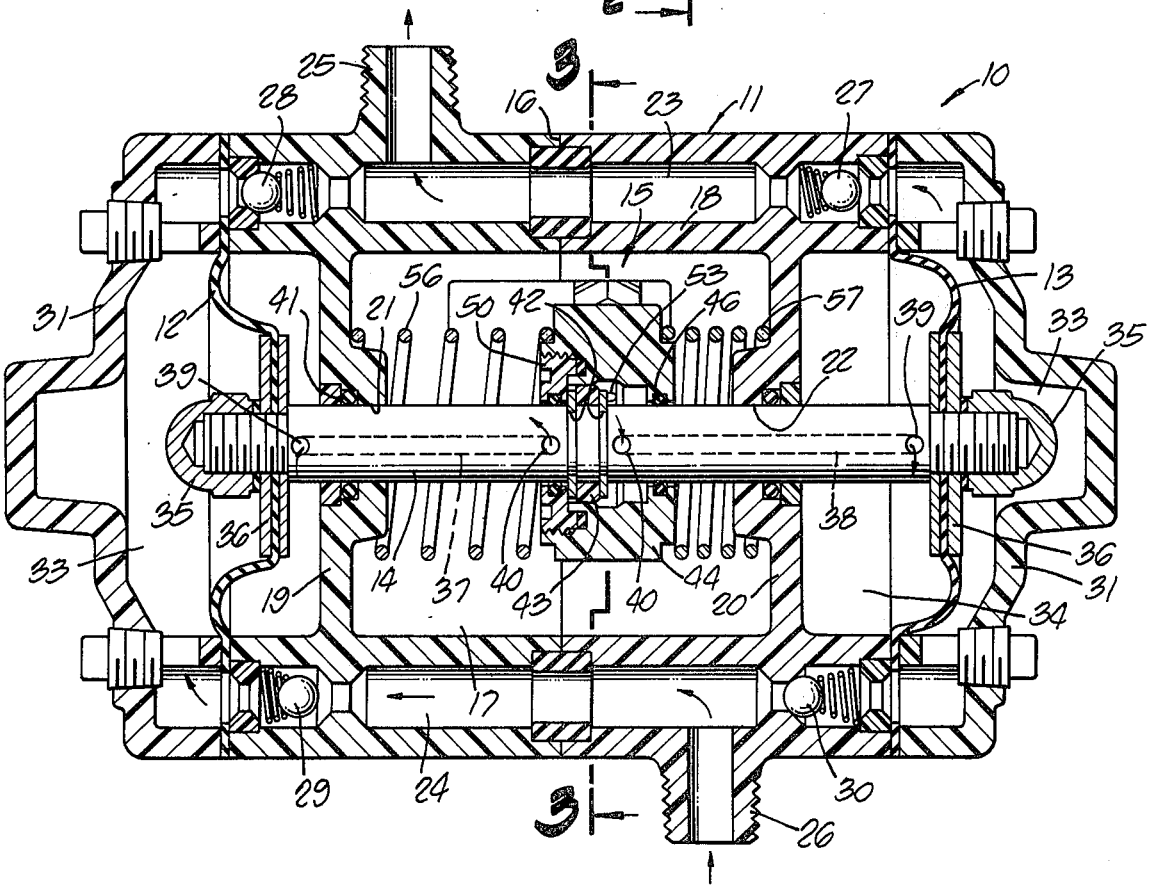
FIG. 2 is a side elevational, sectional view of the apparatus taken along the line 2—2 of FIG. 1.

Turning now to the drawing, and particularly to FIGS. 1 and 2, the pumping apparatus of this invention is enumerated generally as at 10. It is seen to include a generally elongate, hollow cylindrical housing, 11, first and second pressurizing diaphragms 12 and 13 located at opposite ends of the housing, a shaft 14 interconnecting the two diaphragms, and a valving means 15 on the shaft which alternately applies pressurized gas to each of the diaphragms for effecting double-action pumping of a liquid (e.g., syrup bases) in a manner that will be more fully described.

Still referring to FIG. 2, the housing 11 is seen to be constructed of two substantially identical halves separably joined together along the transverse center line 16 by means not shown. More particularly, the housing includes a centrally located cylindrical chamber 17 defined by a circumferential wall 18 and end walls 19 and 20, the latter including openings 21 and 22 aligned along the housing longitudinal axis.

On opposite sides of the housing there are provided passageways 23 and 24 in the wall 18 which extend longitudinally completely therethrough and are in communication, respectively, with fittings 25 and 26. Ball valves 27 and 28 of conventional construction received in the ends of the passageway 23 are spring loaded to permit fluid flow therethrough into the passageway 23 and prevent flow out. The passageway 24 includes at each end a ball valve 29 or 30 which is biased to allow fluid flow out of the passageway and prevent flow in.

The diaphragm 13 (and the diaphragm 12 as well) is constructed of a flexible sheetlike material such as rubber, which fits over the complete housing end and is secured to the end of the wall 18 by an end bell 31 through the instrumentality of bolts 32. The end bell is spaced from the diaphragm at all times to form a chamber 33 which communicates with the passageways 23 and 24 via openings in the diaphragm at the ball valve locations. A further chamber 34 on the opposite side of the diaphragm is defined by the diaphragm and the outer surface of the end wall 19 or 20 as the case may be.

Each end of the actuating shaft 14 is threaded for receipt through a central opening in the diaphragm and secured thereto by a nut 35. The portions of the diaphragm immediately adjacent the central opening are reinforced as at 36 to protect the diaphragm during operation of the pump apparatus. Also, the shaft is of such length that when the diaphragm 13 is distended as in FIG. 2, the diaphragm 12 will at the same time be oppositely flexed.

The shaft 14 includes a pair of longitudinally extending passages 37 and 38, each having one outlet 39 closely adjacent one diaphragm and a second outlet 40 in the central shaft region. Sealing and retention means 41 allow the shaft to slide freely within openings 21 and 22 while preventing fluid flow therepast.

At each side of the actuating shaft longitudinal center, there are formed grooves 42 for receiving snaprings which secure a friction ring 43 therebetween.

Figure 3:
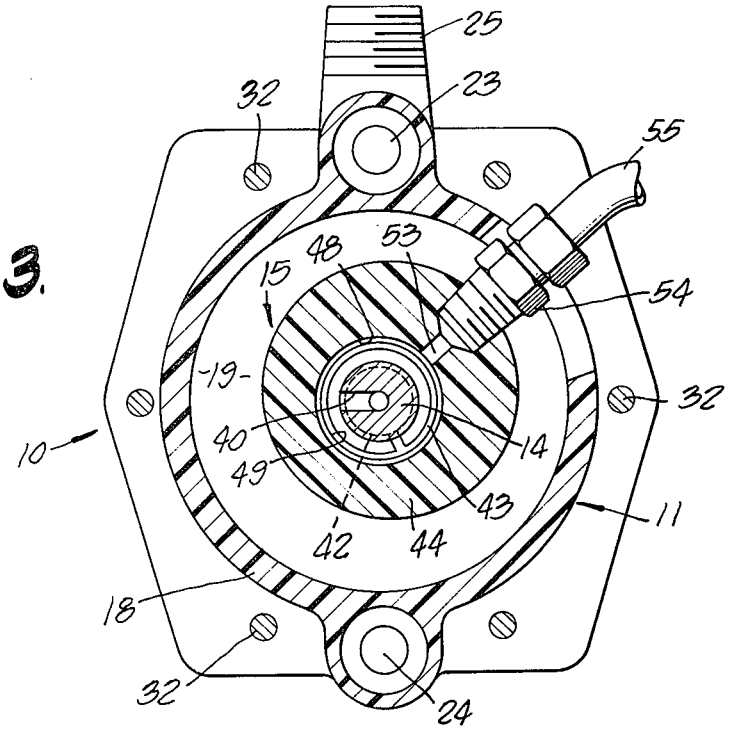
FIG. 3 is a sectional, end elevational view taken along the line 3—3 of FIG. 2.
Figure 4:
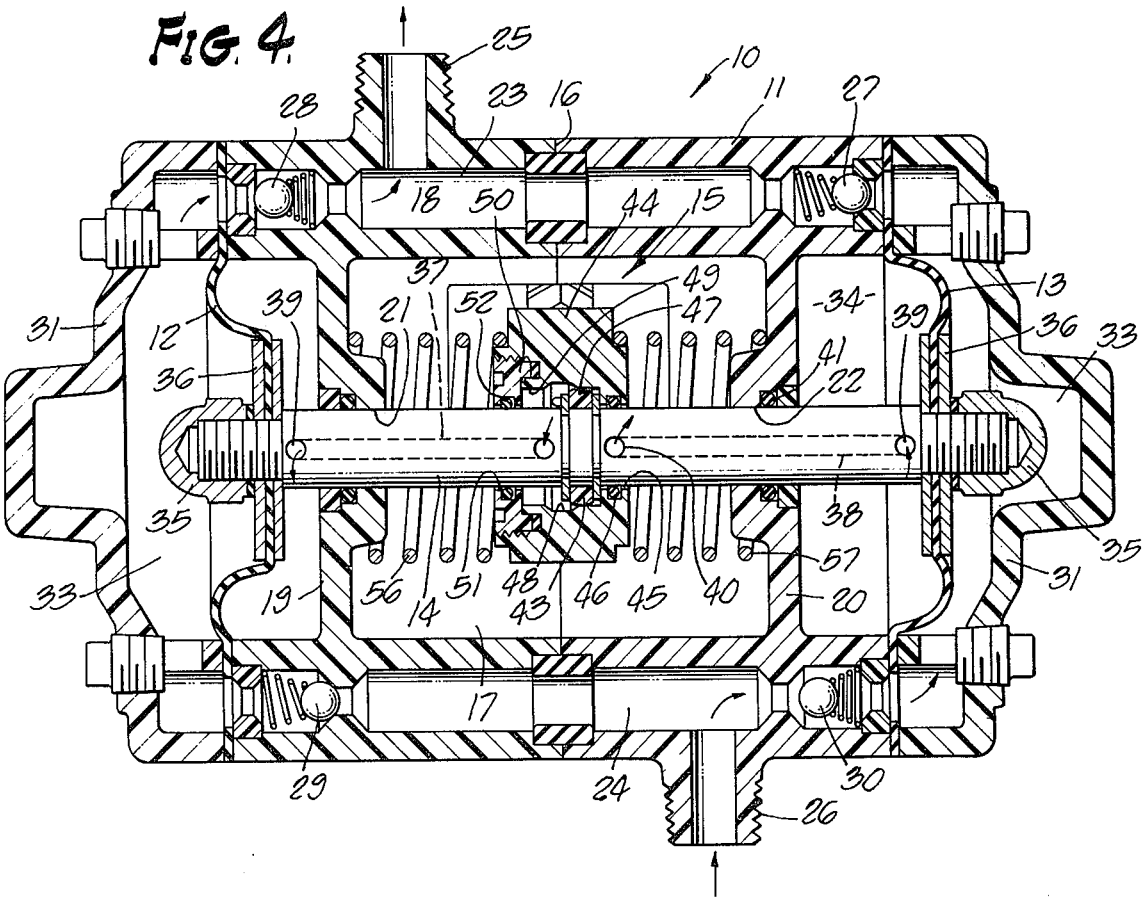
FIG. 4 is a sectional view similar to FIG. 2, only with the pumping apparatus making a pressure stroke in the opposite direction.

As can be seen equally well in either FIG. 2 or 4, the valving member 15 includes a generally annularly shaped body member 44 slidingly received on the shaft. More particularly, the body member bore has a first diametral portion 45 only slightly larger than the shaft diameter which is hermetically sealed to the shaft by an O-ring 46. A second and larger diametral portion 47 is adjacent 45 and can only be received over the ring 43 with frictional engagement between the two. A third diametral bore portion 48 is immediately adjacent 47 and is sufficiently large to allow the ring 43 to move therepast unimpeded. A further diametral portion 49 immediately next to 48 is the same dimensions as 47, such that the ring can be moved therein and be frictionally restrained. An annular insert 50, threaded into the body 44 has a bore 51 identical to 45 having an 0-ring which hermetically seals the valving body interior. As shown in FIG. 3, the valving body 44 has a radially extending passageway 53, via which the body interior is supplied with a pressurized gas (e.g., air) via a fitting 54 and flexible hose 55.

First and second coil compression springs 56 and 57 are received on the shaft 14 at opposite sides of the valving member 15 and continuously engage the housing end walls 19 and 20 and the valving body 44. That is, all other influences ignored, the springs, which are of identical force and construction, continuously urge the valving body 44 toward the shaft longitudinal center with a force depending upon the location of the body along the shaft. The valving member is, however, retained in its relative position on the shaft by the pressurized gas until either one of the springs is fully compressed or the sliding member contacts one of the walls 19 or 20, at which time reversal is initiated and the compressed spring aids positive reversing.

For operation of the pump apparatus, assume the apparatus to initially be as shown in FIG. 2 with fitting 26 interconnected with a source of supply of liquid to be dispensed, fitting 25 interconnected with a suitable dispenser (now open or ready to dispense), and pressurized air or other gas connected to flexible tubing 55. The pressurized air enters shaft opening 40 and exits at opening 38 (right), further distending diaphragm 13 pressurizing fluid in chamber 33 to move through valve 27, passageway 23 and out fitting 25 to be dispensed. During the pressurizing stroke to right just described, the diaphragm 12 has been distending in the opposite direction i.e., toward the right as shown in FIG. 2) which draws liquid to be dispensed through the fitting 26, valve 29 and into the left chamber 33.

Throughout the rightward movement of the shaft 14 as described in the immediately preceding paragraph, the right coil spring is being compressed and therefore exerts an increasing amount of force on the valving body 44 while the left coil spring exerts a reduced force. Finally, during this movement of the shaft to the right a point is reached where the right coil spring force exceeds the frictional force between the ring 43 and valving body walls defining the opening 49 and the retention force of the pressurized gas at which time the body 44 is snapped quickly to the left frictionally lodging the ring 43 within 47 as shown in FIG. 4. In the preferred case, however, the forces acting on the valving member are such that the member will encounter one of the walls 19 or 20 and be moved a certain amount immediately prior to positive reversal.

With the valving body transferred to the FIG. 4 position as just described, the right opening 40 is now exposed to the atmosphere, relieving the pressure in right chamber 34 and thus distending pressure on 13. Now, the pressurized gas is applied against diaphragm 12, moving liquid out through fitting 25 to be dispensed in a similar manner to that already described for the diaphragm 13. It is also important to note that as liquid is moved by diaphragm 12 through ball valve 28, the liquid cannot pass through valve 27, since the liquid pressure tends to close the valve 27 and there is a reduction in pressure in right chamber 33 at this time due to the leftward movement of the shaft which also aids closing of valve 27.

As long as the dispenser is open, the pump apparatus will continue with diaphragms 12 and 13 being alternately driven and the valving member 15 reciprocating along the shaft 14 as described. When the dispenser is shut off and the liquid cannot move out of either chamber 33, a back pressure is exerted against the diaphragm which in its pressurizing stroke causes the shaft to stop and the valving member to maintain whatever position it is in at the moment. Accordingly, a supply of pressurized liquid is maintained at the fitting 25, and thus at the dispenser.

I claim:

1. A double-acting pump apparatus having a pair of pressurizing diaphragms respectively connected to the ends of a shaft, walls enclosing the shaft-connected side of each diaphragm to form a chamber thereabout, valved pump chambers communicating with the respective diaphragm sides opposite the shaft-connected sides, said shaft including a pair of passageways extending therealong, each of which has a first opening communicating with one of said chambers and a second opening spaced from said first opening and lying outside said chambers, comprising:

an annular valving member slidingly received on said shaft outwardly of said chambers and having an internal chamber for connection with a source of supply of pressurized gas;

first and second compression coil springs received on said shaft at opposite sides of said valving member, said springs engaging both the valving member and one of the walls defining a diaphragm chamber and each spring continuously urging said valving member toward the other spring, whereby said valving member will experience a reciprocating movement along said shaft to interconnect one of said shaft second openings with the pressurized gas while at the same time leaving the other second opening exposed, and then changing interconnection with said shaft second openings; and a friction ring received on said shaft between the shaft second openings which engages interfering parts of the valving member defining the valving chamber and serves as a limit stop for the reciprocating movement on said shaft.

2. Pump apparatus as in claim 1, in which said valving member includes sealing means interrelating said member and said shaft, preventing leakage of the pressurized gas outwardly from the valving member chamber.

3. Double-acting pump apparatus, comprising:

a housing;

first and second walls of said housing being spaced from one another and including aligned openings therein;

a shaft having its end portions slidingly received through the respective openings;

first and second diaphragms affixed to the respective ends of the shaft and having their peripheries secured to the housing defining first and second chambers about the housing openings;

inlet and outlet valved pump chambers communicating respectively with the first and second diaphragm;

first and second passage means extending along said shaft, each such means including a first opening adjacent the shaft end within one of the chambers, and a second opening located outside the chambers;

a valving member having a bore passing therethrough via which said member is slidingly received on said shaft outside both said chambers, said member having an enclosed cavity surrounding at least a portion of said shaft for interconnection with a source of supply of pressurized gas;

said valving member being reciprocated along said shaft from a first position where one of said passage means second openings is in communication with the pressurized gas in said cavity and the other second opening is exposed, to a further position where the relation of the two second openings to the valving member is reversed; and a friction ring being received on said shaft between the shaft second openings which engages interfering parts of the valving member defining the valving member chamber and serves as a limit stop for the reciprocating movement on said shaft.

4. Pump apparatus as in claim 3, in which said valving member includes sealing means interrelating said member and said shaft, preventing leakage of the pressurized gas outwardly from the valving member chamber.

5. A double-acting pump apparatus having a pair of pressurizing diaphragms respectively connected to the ends of a shaft, walls enclosing the shaft-connected side of each diaphragm to form a chamber thereabout, valved pump chambers communicating with the respective diaphragm sides opposite the shaft-connected sides, said shaft including a pair of passageways extending therealong, each of which has a first opening communicating with one of said chambers and a second opening spaced from said first opening and lying outside said chambers; comprising:

an annular valving member slidingly received on said shaft outwardly of said chambers and having an internal chamber for connection with a source of supply of pressurized gas, said valving member including a threaded insert at one end thereof which is slidingly received on said shaft; and first and second compression coil springs received on said shaft at opposite sides of said valving member, said springs engaging both the valving member and one of the walls defining a diaphragm chamber and each spring continuously urging said valving member toward the other spring, whereby said valving member will experience a reciprocating movement along said shaft to interconnect one of said shaft second openings with the pressurized gas while at the same time leaving the other second opening exposed, and then changing interconnection with said shaft second openings.

6. Double-acting pump apparatus, comprising:

a housing;

first and second walls of said housing being spaced from one another and including aligned openings therein;

a shaft having its end portions slidingly received through the respective openings;

first and second diaphragms affixed to the respective ends of the shaft and having their peripheries secured to the housing defining first and second chambers about the housing openings;

inlet and outlet valved pump chambers communicating respectively with the first and second diaphragm;

first and second passage means extending along said shaft, each such means including a first opening adjacent the shaft end within one of the chambers, and a second opening located outside the chambers;

a valving member having a bore passing therethrough via which said member is slidingly received on said shaft outside both said chambers, said member having an enclosed cavity surrounding at least a portion of said shaft for interconnection with a source of supply of pressurized gas and a threaded insert at one end thereof, which is slidingly received on said shaft; and said valving member being reciprocated along said shaft from a first position where one of said passage means second openings is in communication with the pressurized gas in said cavity and the other second opening is exposed, to a further position where the relation of the two second openings to the valving member is reversed.

* * * * *